US011441346B2

(12) United States Patent
Caccaro

(10) Patent No.: US 11,441,346 B2
(45) Date of Patent: Sep. 13, 2022

(54) HINGED DOOR LEAVES FOR WARDROBES, WALK-IN CLOSETS AND PIECES OF FURNITURE IN GENERAL, PROVIDED WITH MAGNETIC DAMPING AND RETURN DEVICES

(71) Applicant: Caccaro Srl, Villa del Conte (IT)

(72) Inventor: Maurizio Caccaro, Villa del Conte (IT)

( * ) Notice: Subject to any disclaimer, the term of this patent is extended or adjusted under 35 U.S.C. 154(b) by 21 days.

(21) Appl. No.: 17/048,032

(22) PCT Filed: Nov. 30, 2018

(86) PCT No.: PCT/IB2018/059502

§ 371 (c)(1),
(2) Date: Oct. 15, 2020

(87) PCT Pub. No.: WO2019/202377

PCT Pub. Date: Oct. 24, 2019

(65) Prior Publication Data

US 2021/0189781 A1 Jun. 24, 2021

(30) Foreign Application Priority Data

Apr. 16, 2018 (IT) ..... 102018000004535

(51) Int. Cl.

| | |
|---|---|
| ***E05D 15/26*** | (2006.01) |
| ***E05D 15/04*** | (2006.01) |
| ***E05F 5/02*** | (2006.01) |

(52) U.S. Cl.

CPC ..... *E05D 15/264* (2013.01); *E05D 15/04* (2013.01); *E05F 5/02* (2013.01); *E05Y 2201/21* (2013.01); *E05Y 2201/246* (2013.01); *E05Y 2201/46* (2013.01); *E05Y 2201/686* (2013.01); *E05Y 2600/46* (2013.01); *E05Y 2900/132* (2013.01); *E05Y 2900/20* (2013.01)

(58) Field of Classification Search

CPC ..... E05D 15/264; E05D 15/04; E05D 15/262; E05F 5/02; E05Y 2201/21; E05Y 2201/246; E05Y 2201/46; E05Y 2201/686; E05Y 2600/46; E05Y 2900/132; E05Y 2900/20

See application file for complete search history.

(56) References Cited

U.S. PATENT DOCUMENTS 2,042,954 A * 6/1936 Memmel ..... E05F 1/1016 16/80
2,598,814 A * 6/1952 Mcafee ..... E05F 17/004 312/275

(Continued)

FOREIGN PATENT DOCUMENTS

| | | |
|---|---|---|
| DE | 202015003214 | 7/2015 |
| DE | 102015119505 | 1/2017 |
| WO | 2014180729 | 11/2014 |

*Primary Examiner* — Victor D Batson
*Assistant Examiner* — Matthew J Sullivan
(74) *Attorney, Agent, or Firm* — Themis Law

(57) ABSTRACT

A device for moving folding door leaves that open completely and are adapted for wardrobes or pieces of furniture in general include a single door leaf or one pair of door leaves hinged to each other, configured to be rotated from a completely closed configuration to a completely open configuration. The door leaves include a guiding device, the action of which is damped during the opening and closing movement by magnetic devices and damping systems that counteract their attraction force.

8 Claims, 10 Drawing Sheets

(56) References Cited

U.S. PATENT DOCUMENTS 4,348,069 A * 9/1982 Lindsay ..... E06B 3/482 16/80
5,938,306 A * 8/1999 Lambright ..... E06B 3/482 312/324
6,640,387 B2 * 11/2003 Alonso ..... E05F 3/221 16/72
6,695,390 B2 * 2/2004 Bucco Morello ..... B60J 5/0498 160/210
7,448,703 B2 * 11/2008 Kung ..... E05F 1/10 312/327
8,839,559 B2 * 9/2014 Neff ..... E05F 3/18 49/344
8,931,140 B2 * 1/2015 Salice ..... E05F 5/006 16/286
10,240,375 B2 * 3/2019 Brunnmayr ..... E05D 15/264
10,480,237 B2 * 11/2019 Battlogg ..... F16F 9/20
11,060,338 B2 * 7/2021 Reid ..... E05F 3/108
11,136,807 B2 * 10/2021 Battlogg ..... E05F 5/00
2002/0066229 A1 6/2002 Rubio
2008/0092333 A1 * 4/2008 Migli ..... E05F 5/006 188/266
2008/0196203 A1 * 8/2008 Giovannetti ..... E05D 3/14 16/239
2009/0120232 A1 * 5/2009 Choi ..... G05G 5/03 74/512
2009/0178770 A1 * 7/2009 Teunissen ..... E05D 15/26 160/199
2011/0204072 A1 * 8/2011 Sugasawara ..... E05D 3/14 16/382
2013/0008917 A1 * 1/2013 Huang ..... E05D 15/262 49/358
2013/0145695 A1 * 6/2013 Wach ..... E05B 17/0041 49/381
2013/0145696 A1 * 6/2013 Wach ..... E05C 17/16 49/386
2015/0096694 A1 * 4/2015 Bonetti ..... E06B 3/481 160/213
2019/0150640 A1 * 5/2019 Scott ..... A47F 3/12
2019/0234480 A1 * 8/2019 Bu ..... F16F 15/022
2019/0309552 A1 * 10/2019 Fingerle ..... E05D 15/1013
2021/0355729 A1 * 11/2021 Bohle ..... E05D 15/262

* cited by examiner

HINGED DOOR LEAVES FOR WARDROBES, WALK-IN CLOSETS AND PIECES OF FURNITURE IN GENERAL, PROVIDED WITH MAGNETIC DAMPING AND RETURN DEVICES

The present invention concerns door leaves for wardrobes, walk-in closets and pieces of furniture in general, and more specifically it concerns folding door leaves opening completely and provided with a guiding device with magnetic braking system.

Wardrobes, walk-in closets and pieces of furniture in general are known, which comprise one door leaf or two door leaves hinged to each other, of which a first door leaf is hinged also to the fixed structure of the wardrobe, meaning to a jamb or to a side or to a vertical door leaf, which in any case is a fixed component of the wardrobe, and a second door leaf, if any, is hinged to said first door leaf.

Said first door leaf is hinged to the fixed structure of the wardrobe by means of hinges, which however must allow the door leaf to rotate by an angle of at least 90°. Hinges allowing opening angles of more than 90° are preferably used.

Said second door leaf, instead, is generally hinged to said first door leaf by means of common hinges for folding door leaves that allow the door leaves to perform a relative rotation from 0° to 180° with respect to each other.

The two door leaves can rotate with respect to each other and also with respect to the side of the wardrobe in order to pass from a closed configuration of the compartment defined inside the wardrobe, in which said door leaves are substantially aligned with each other so as to form a straight plane, to an open configuration of the same compartment, in which said door leaves are folded, meaning rotated so as to form a pack or sandwich-shaped structure.

Guiding devices designed to facilitate the opening/closing movement of folding door leaves are known, which for example comprise one or more rails installed on the top and/or on the base of the wardrobe, inside which pins or sliding elements in general slide, wherein said pins or sliding elements are installed on said second door leaf, in a corresponding position.

Thus, the door leaf can be moved from the closed configuration of the compartment to the open configuration of the same, wherein the pack formed by said folded door leaves forms an angle of approximately 90° with the plane of the compartment defined inside the wardrobe.

Various types of folding door leaves that open completely are also known, which are provided with a compact size guiding device.

The patents WO2016/075051, WO2016/083217, WO2016/075050, WO2014/180729, M520453 TV2014A000051 are known, which describe a damping and return device for sliding door leaves, comprising magnetic shock absorbing elements applied to fixed guides for opening and closing sliding door leaves of pieces of furniture.

The subject of the present invention consists of door leaves for wardrobes, walk-in closets and pieces of furniture in general, comprising a new guiding device designed to facilitate their rotation, wherein said guiding device comprises at least one first rod with variable length, provided with one or more damping and/or return devices and hinged to the top of the wardrobe and to said first door leaf, and a possible second rod having fixed length and suited to be directly or indirectly hinged to the external side of the top of the wardrobe and to the upper edge of a possible second door leaf hinged to the first door leaf.

Said first rod has variable length and comprises at least two aligned half rods which slide with respect to each other, provided with at least one damping and/or return device comprising magnetic elements, even in combination with elastic or pneumatic elements, and wherein said damping and return device is active both with the door leaf/leaves in the completely closed configuration and with the door leaf/leaves in the completely open configuration.

One end of said first rod is suited to be hinged to the external upper surface of the top of the wardrobe, so that it can rotate on a plane which is substantially parallel and close to the top itself, while the opposite end of the rod is hinged to said first door leaf by means of an element designed to adjust or support the rod, through which it is possible to adjust the position of the point of rotation of the bar with respect to the door leaf.

In the case of two door leaves hinged to each other, one end of said second rod with fixed length is suited to be hinged to the external upper surface of the top of the wardrobe, so that it can rotate on a plane which is substantially parallel and close to the top itself, while the opposite end of the second bar is hinged to said second door leaf through a plate or element designed to adjust or support the rod, through which it is possible to adjust the position of the point of rotation of the second rod with respect to the second door leaf.

There are holes designed to allow the insertion of fixing screws, said holes being preferably in the shape of slots, in order to allow the adjustment of the position of the plate on the upper edge of the second door leaf, and consequently of the position of the second point of rotation of the rod, which makes it possible to guarantee the correct alignment of the door leaf, especially in the closed configuration.

Since said device is installed on the door leaf, and in particular on the top of the wardrobe, it does not occupy any space inside the wardrobe and moreover it does not prevent the complete opening of the door leaves, which therefore can be folded completely, arranging said door leaves so that they face and are parallel to each other, and wherein the first door leaf is rotated by 180° with respect to the compartment defined inside the wardrobe.

The characteristics of the new door leaves for wardrobes, walk-in closets and pieces of furniture in general with guiding device will be highlighted in greater detail in the following description, with reference to the drawings, which are enclosed by way of non-limiting example.

FIGS. 1, 2, 3, 4, 5 and 6 show a detail of the new door leaves (A, B) with guiding device (D) in six different positions, from the closed position, shown in FIG. 1, to the completely open position, shown in FIG. 6.

FIG. 7, instead, shows a top view of the wardrobe with the magnetic damping and return device on the first door leaf and the guiding device on the second door leaf.

FIGS. 8, 9 show a top and a bottom view of the first rod with variable length, while

Figure 16:
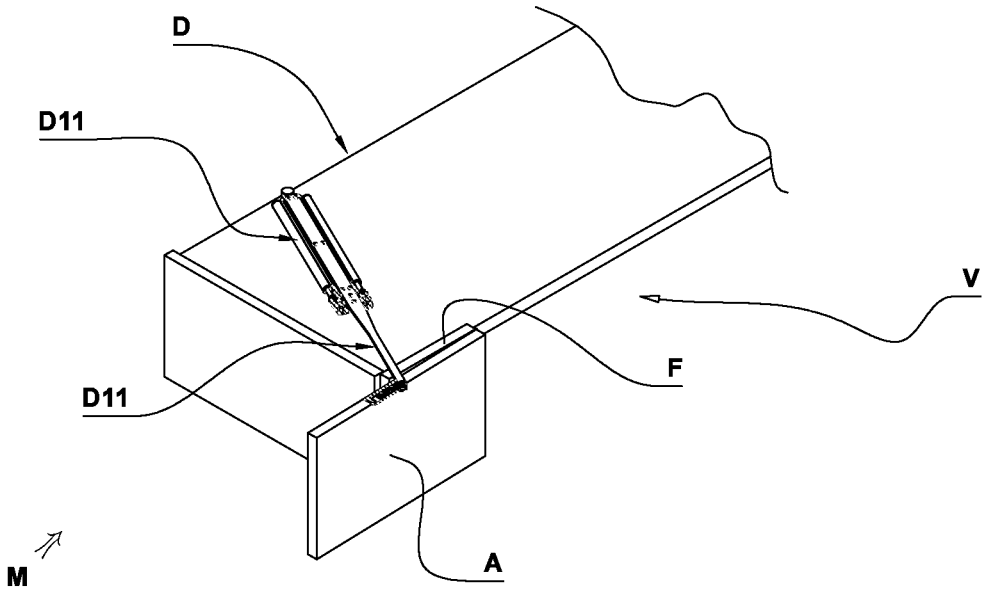
Figure 17:
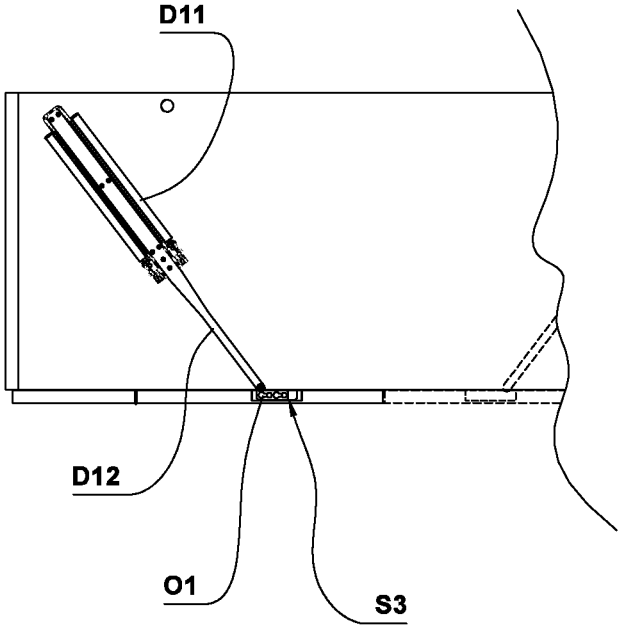

FIG. 16, instead, shows a top view of the wardrobe with magnetic damping and return device on the door leaf.

Figures from 1 to 6 show, by way of non-limiting example, a wardrobe, walk-in closet, piece of furniture in general comprising at least two folding door leaves opening completely, with magnetic damping and return device and guide (D) for said first door leaf (A) and said second door leaf (B).

Said first door leaf (A) is hinged to the fixed structure (F) of the wardrobe (M). In the example of FIGS. 1-6, said first door leaf (A) is hinged to a vertical door leaf (F) fixed in any way to the wardrobe (M), while the second door leaf (B) is hinged to said first door leaf (A).

Figure 1:
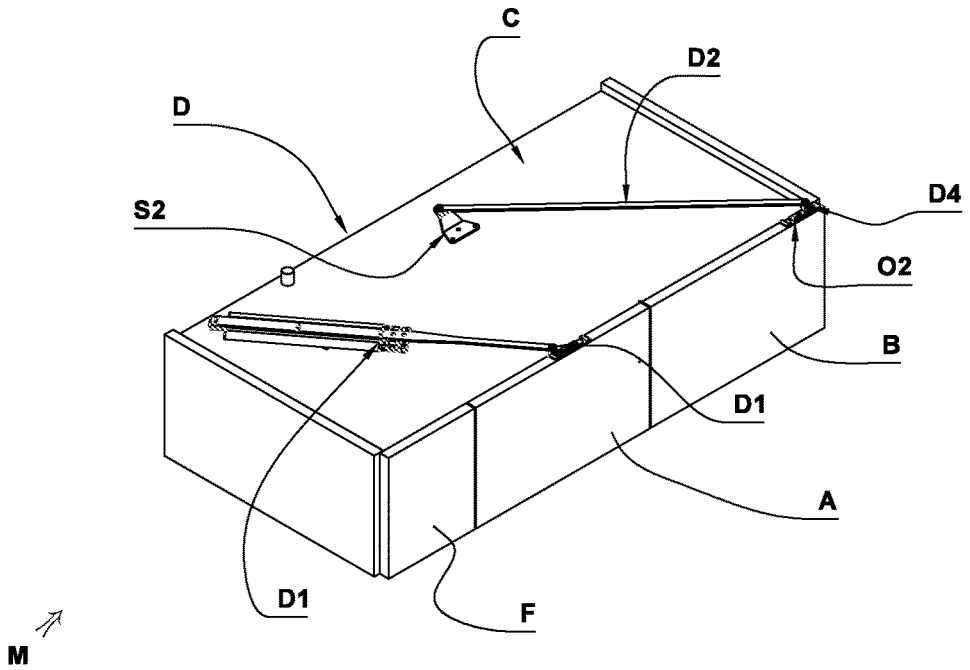
Figure 2:
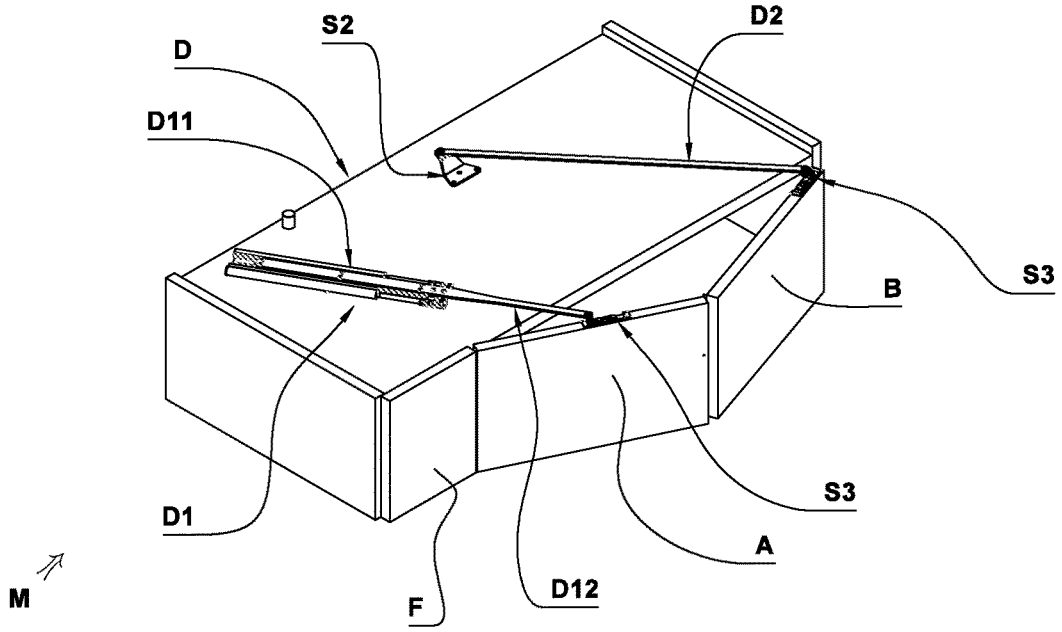
Figure 3:
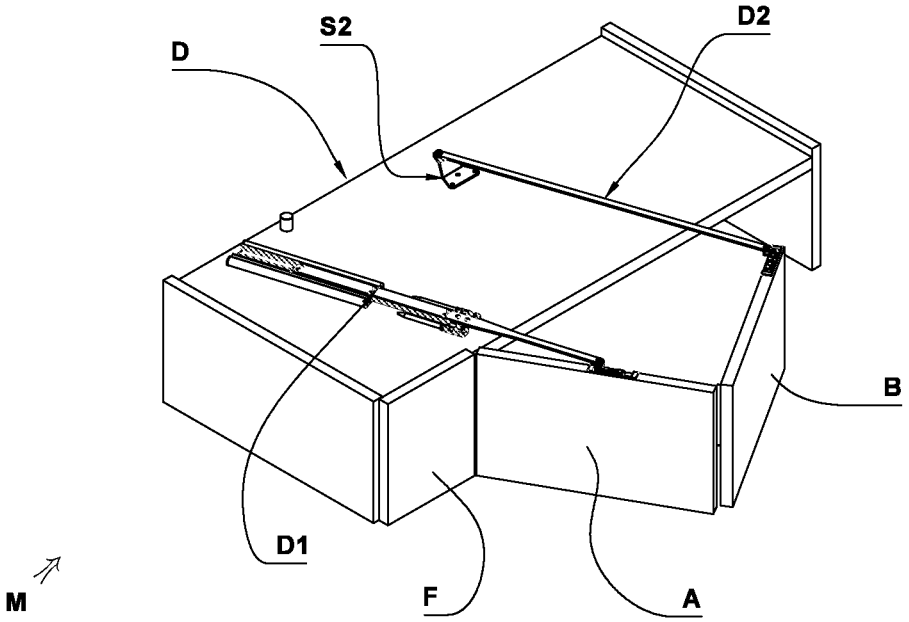
Figure 4:
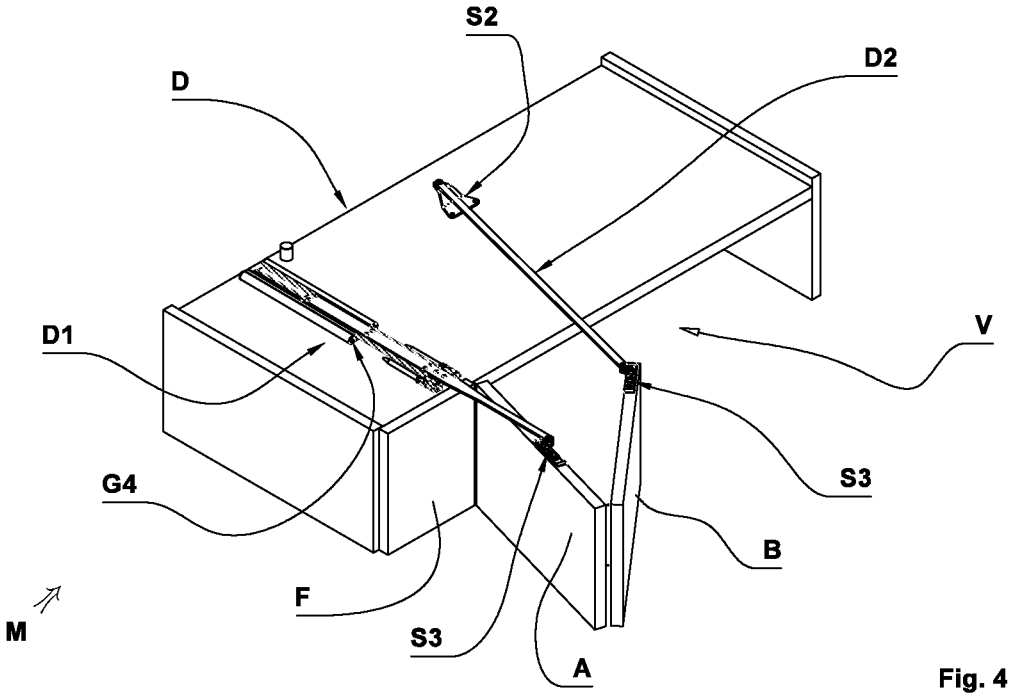
Figure 5:
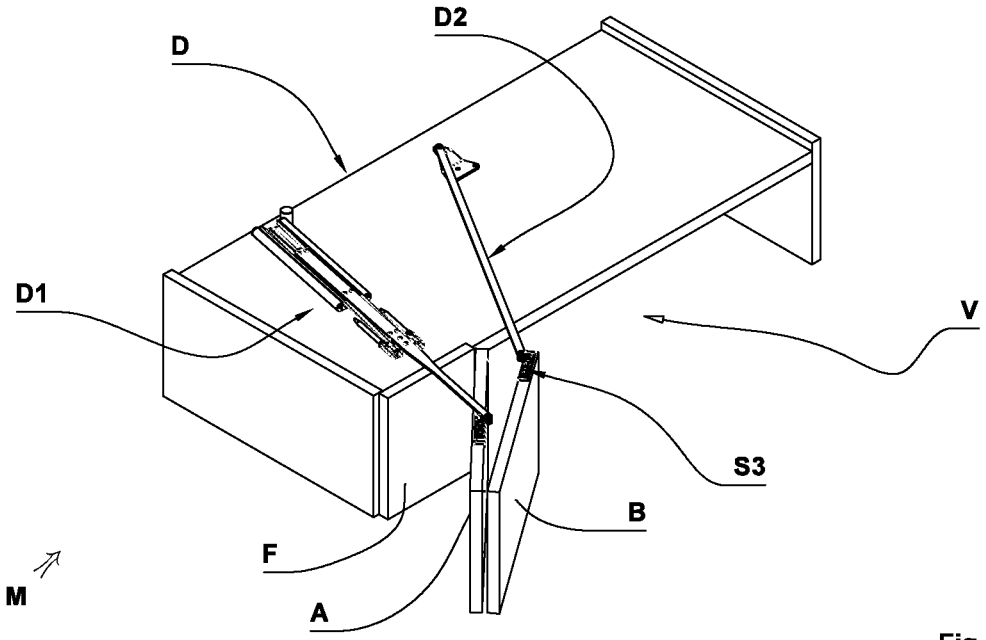
Figure 6:
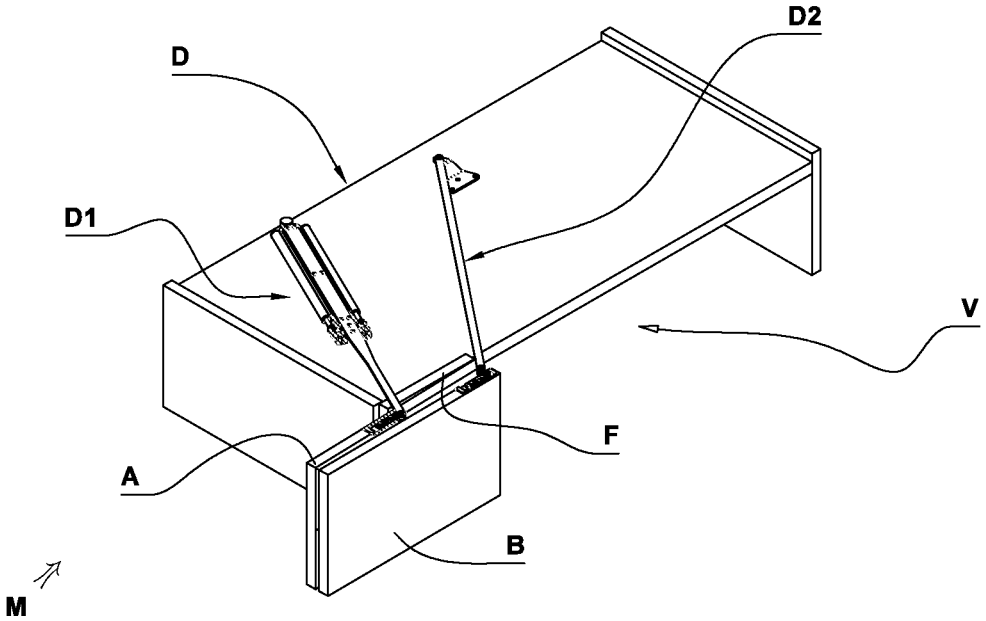

Said door leaves (A, B) rotate in order to pass from the closed configuration of the compartment (V) defined in the wardrobe, schematically shown in FIG. 1, to the completely open configuration of the compartment (V), schematically shown in FIG. 6.

In said specific closed configuration, said door leaves (A, B) are substantially aligned with each other in such a way as to form a plane and are also aligned with the fixed structure of the wardrobe (M), in such a way as to perfectly close the compartment (V) defined in the wardrobe.

In the completely open configuration, said door leaves (A, B) are folded, that is, they face each other and are parallel to each other.

Said first door leaf (A) is hinged to said fixed door leaf (F) of the wardrobe (M), preferably through hinges of the concealed type, which are suited to allow a complete 180° rotation and mounted in apposite seats created between the adjacent upper edges of said first door leaf (A) and said fixed door leaf (F).

Said wardrobe (M) is also provided with guiding devices comprising at least one first magnetic damping and return rod (D1), hinged between the external side of the top (C) of the wardrobe (M) and the upper edge of said first door leaf (A), and at least one second guiding rod (D2) hinged between the external side of the top (C) of the wardrobe (M) and the upper edge of said second door leaf (B), said rods being suited to guide the rotation movement of the door leaves (A, B) between said closed and open configurations.

Said first rod (D1) can be directly or indirectly hinged to a bracket or spacer (S1), in turn fixed to said external side of the top (C) of the wardrobe (M) and suited to maintain said rod (D1) raised and to make it rotate on a plane which is parallel and close to the top (C) of the wardrobe (M).

Said second rod (D2) can be directly or indirectly hinged to a bracket or spacer (S2), in turn fixed to said external side of the top (C) of the wardrobe (M) and suited to maintain said rod (D2) raised and to make it rotate on a plane that is parallel and close to the top (C) of the wardrobe (M).

Said brackets or spacers (S1, S2) are fixed to said top (C) of the wardrobe (M) in a specific position according to the two open and closed configurations of the door leaves (A, B).

The ends of the rods (D1, D2) are fixed to the upper edges of said first door leaf (A) and second door leaf (B) preferably through plates (S3) provided with holes (O1, O2) for the insertion of fixing screws, positioned on the upper edge of said first door leaf (A) and second door leaf (B), and wherein said holes (O1, O2) are preferably slot-shaped in order to allow the adjustment of the position of the rotation point of the end of the rod (D1, D2) with respect to the upper edge of said first door leaf (A) and second door leaf (B), thus making it possible to adjust the position of the point of rotation of the rods (D1, D2).

More specifically, in order to correctly align the two door leaves (A, B) it is sufficient to translate one or both of said plates (S3) on the free edge of the door leaves (A, B).

Figure 7:
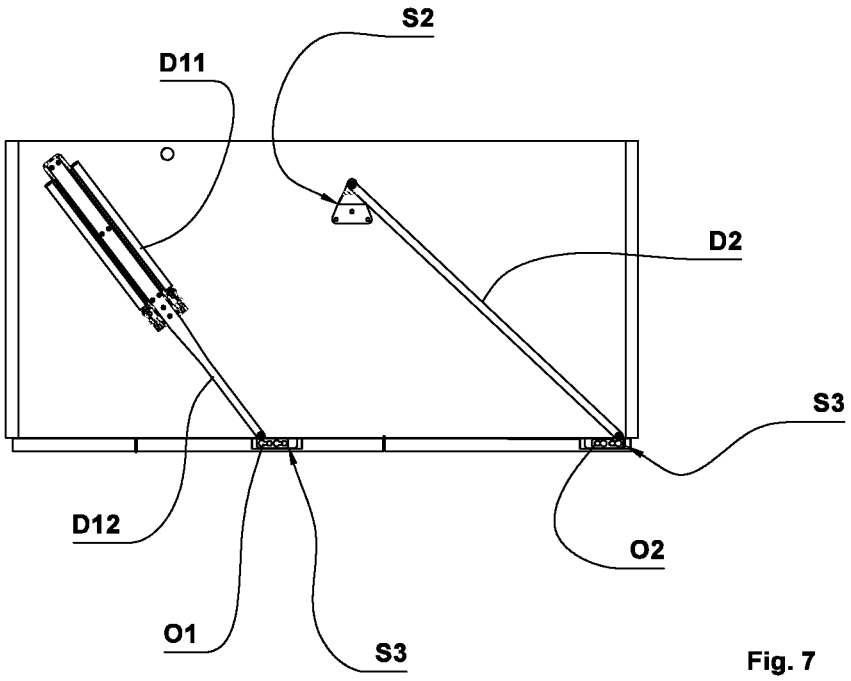
Figure 8:
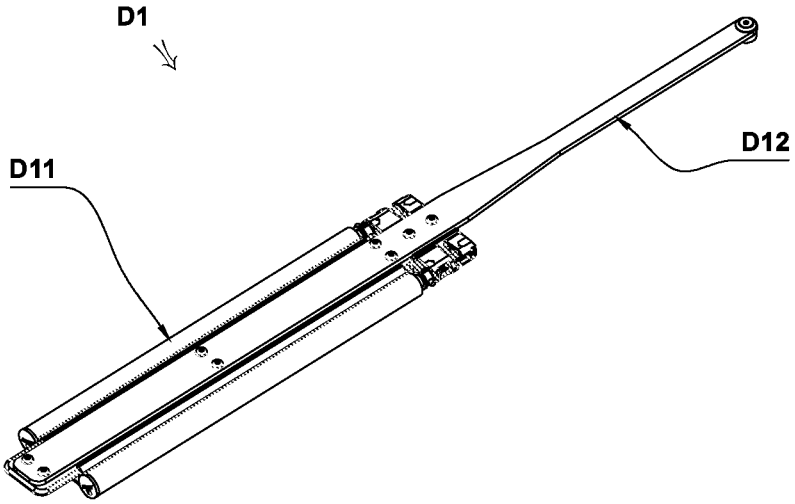
Figure 9:
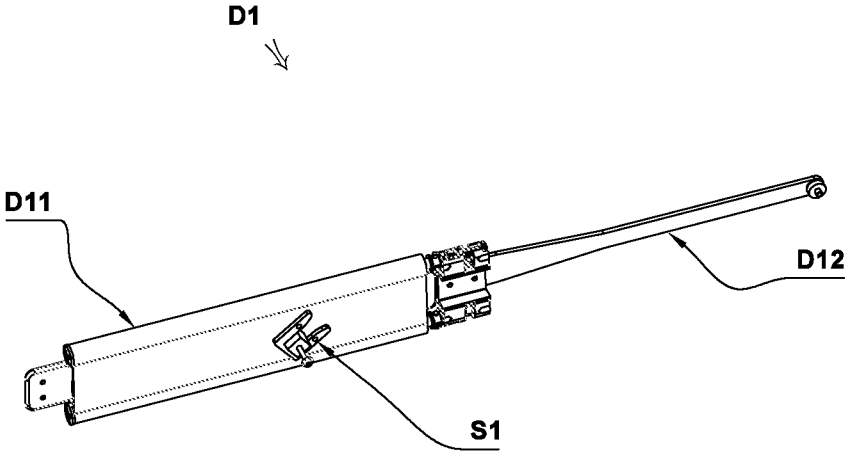
Figure 10A:
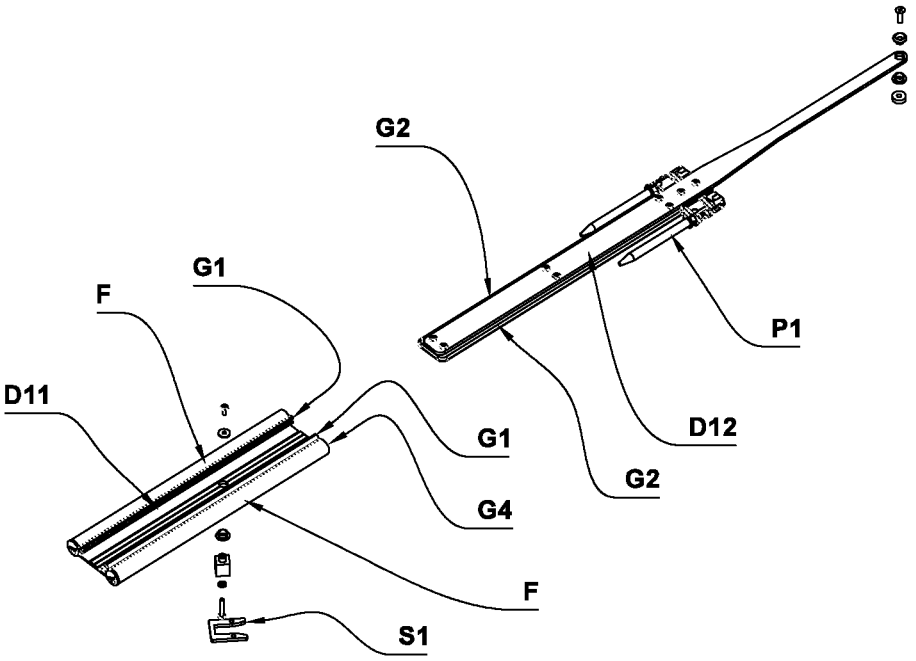
FIGS. 10*a*, 10, 10*c*, 10*d* show the device in its entire length with a first half rod extracted from the second half rod of the first rod (D1) and its main components.
Figure 10B:
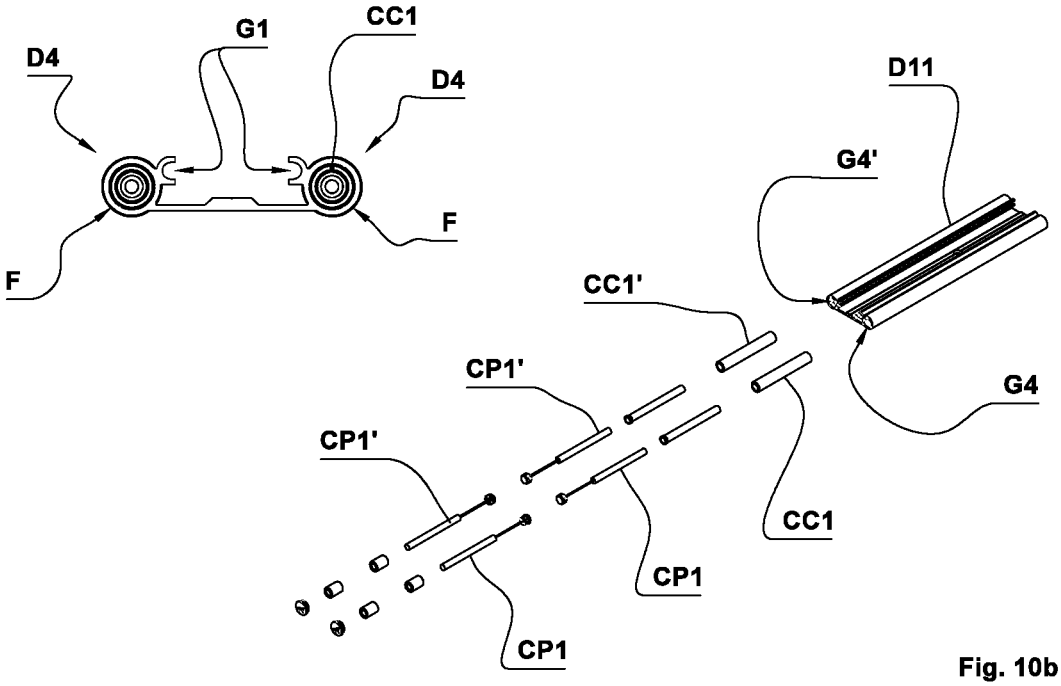
Figure 10C:
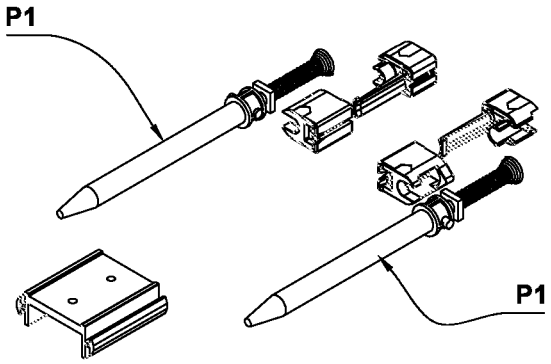
Figure 10D:
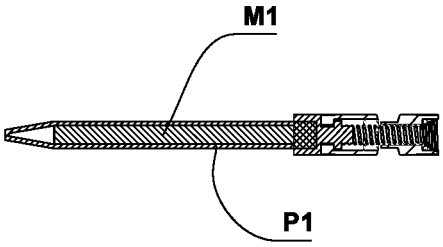
Figure 11:
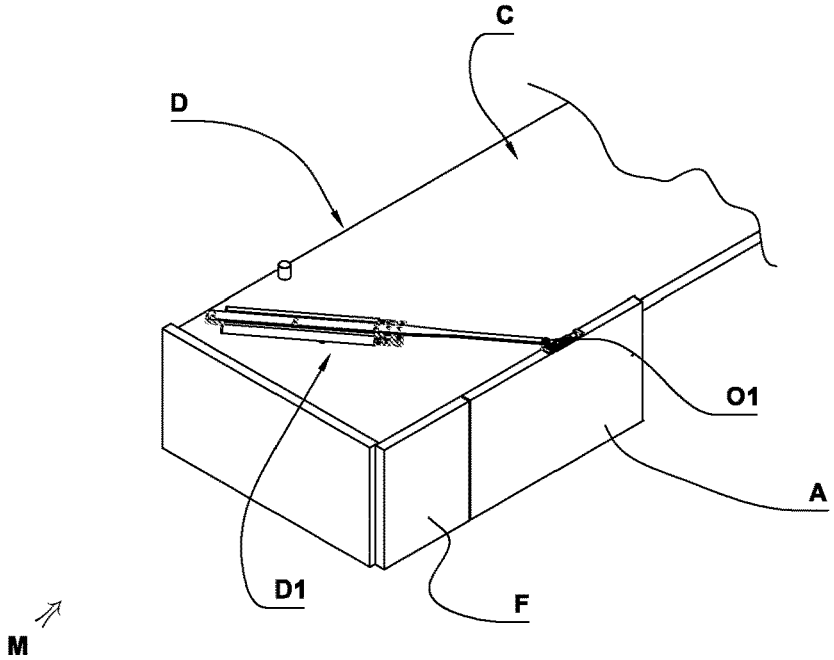
FIGS. 11, 12, 13, 14, 15 show a detail of the solution with one door leaf (A) with guiding device (D1) in six different positions, from the closed position, shown in FIG. 11, to the completely open position, shown in FIG. 15.
Figure 12:
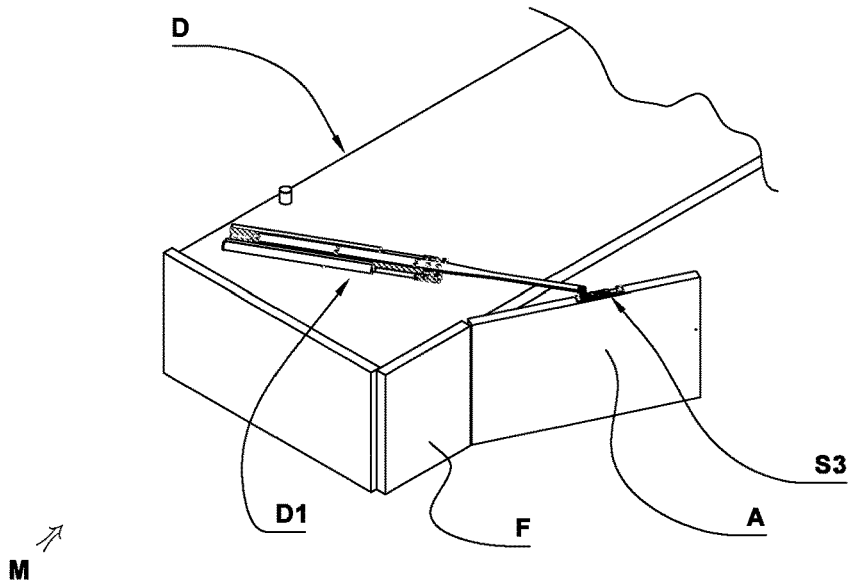
Figure 13:
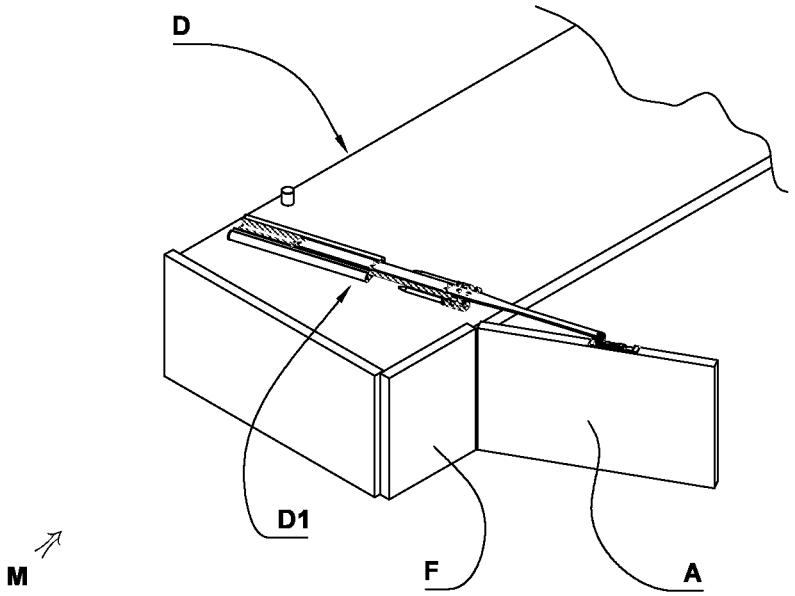
Figure 14:
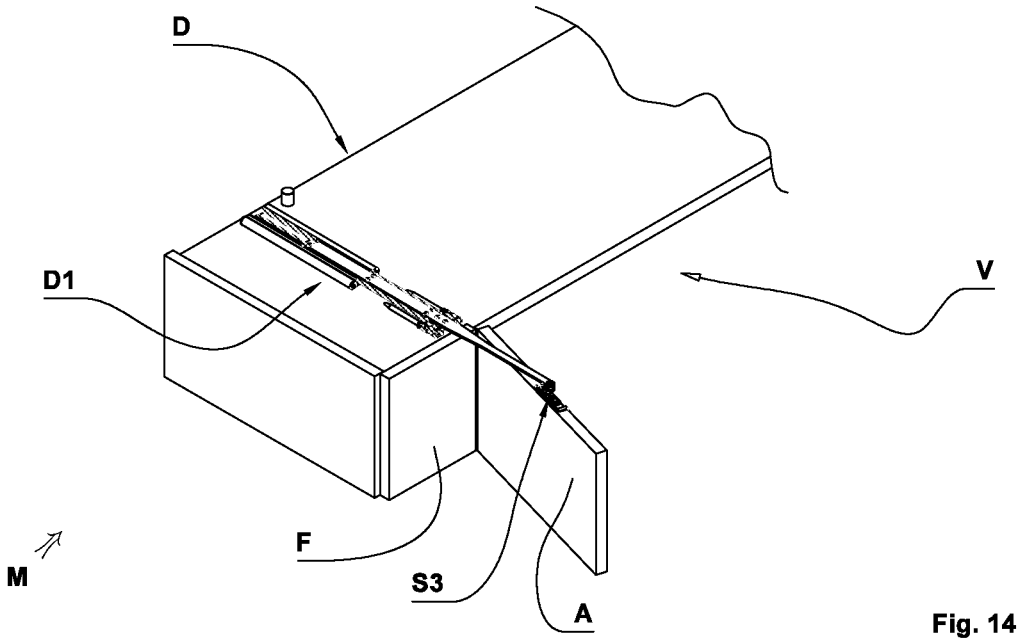
Figure 15:
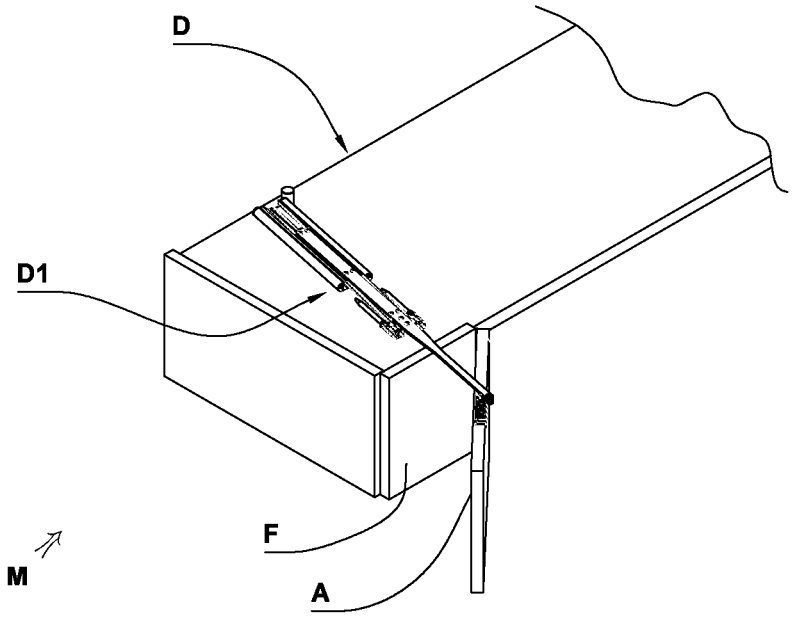

Said first rod (D1) comprises two half rods (D11, D12) (FIG. 7) which slide with respect to each other thanks to the presence of guides (G1, G2), in such a way as to allow the end hinged to the door leaf (A) to be moved near to and away from its point of constraint on the top of the wardrobe (M).

According to the invention, said first rod (D1) is hinged to said top (C) of the wardrobe (M) through a bushing or a locking or coupling device (S1).

The first half rod (D11) comprises cylindrical hollow bodies (G4) which are integral with the half rod (D11) itself, while said second half rod (D12) comprises pins (P1), the inside of which is provided with magnetic bodies, and wherein said pins (P1) are suited to slide in the holes of said cylindrical hollow bodies (G4) of said first half rod (D11).

Said first rod (D1) comprising said two half rods (D11, D12) is also provided with shock absorbing elements or braking and damping devices which are combined with a magnetic return device, are integral with the rod (D1) itself and are suited to facilitate the return of the first door leaf (A) and to brake it in its closing and opening movement, and wherein said first rod (D1) is hinged to said bushing or coupling device (S1).

Therefore, said first rod (D1) serves the function of damping the movement of the door leaf (A) during opening and closing and at the same time of facilitating the return of said door leaf (A), holding it in the open and closed configurations.

The action of moving the ends of said first rod close to each other will thus be facilitated and they will be held in their final position by said magnetic elements which, in the completely retracted position of the half rods, keep said two ends of the rod with variable length (D1) near each other, thus closing the door leaves (A, B) in a stable manner and keeping them aligned with the fixed part of the wardrobe, and also keeping them folded in a compact manner in the completely open configuration.

Both in the totally closed configuration of the piece of furniture, with said two door leaves (A, B) aligned with each other, and in the totally open configuration, in which the two open door leaves are superimposed, said pins (P1) will be at least partially introduced in said hollow cylinders (G4), exerting a constant attraction force during the opening and/or closing movements thanks to the presence of the magnets and thus keeping said door leaves (A, B) in a stable position.

According to the invention, elastic or pneumatic elements (CP1) can be provided, which are placed inside the hollow cylinders (CC1) and are compressed due to the attraction force exerted by the magnetic elements (P1) with the purpose of damping the force exerted by said pins (P1) when accompanying said door leaves (A, B), during the opening and/or closing movement, with a constant and soft movement.

Said damping elements (CP1), always placed inside the hollow cylinders (CC1), during the closing movement are compressed by the action of the magnetic elements (P1).

The above can be applied also in the case of a wardrobe provided with a single door leaf suited to rotate by 180°. In this case, the device will thus comprise said first rod (D1) with variable length, in any way provided with the already mentioned adjusting and moving devices.

Therefore, with reference to the above description and the attached drawings, the following claims are expressed.

The invention claimed is:

1. A device configured to move a hinged door leaf and open the hinged door leaf completely, the hinged door leaf opening comprising a first door leaf (A) hinged to a fixed structure and adapted to rotate from a first configuration, in which a compartment defined inside a wardrobe is closed to a second configuration, in which the wardrobe is open, the device comprising:

a first rod (D1) hinged between an external side of a top (C) of the wardrobe and an upper edge of said first door leaf (A), in such a way that the first rod rotates on a plane which is parallel to the top (C), the first rod comprising at least a first half rod and a second half rod (D11, D12) that are engaged to each other and slide longitudinally one on top of the other so as to increase/decrease a distance between a first hinge point on the top of the wardrobe and a second hinge point on the door leaf (A), wherein said second half rod (D12) is equipped with shock absorbing devices or braking and damping devices (P1) operated through magnetic attraction and integral with the second half rod (D12), the shock absorbing devices or braking and damping devices counteracting an opening movement and braking a closing movement of the first door leaf (A), wherein said shock absorbing devices or braking and damping devices (P1) are configured as magnetized pins and said first half rod includes magnetized hollow cylinders, and wherein a sliding of the second half rod on top of the first half rod causes said pins to be received in said hollow cylinders and to have the magnetic attraction therewith.

2. The device according to claim 1, further comprising:

a second door leaf (B) hinged to said first door leaf (A), wherein said first and said second door leaves (A, B) rotate from the first configuration in which the compartment is closed to the second configuration in which the compartment is open, said first and said second door leaves (A, B) comprising rotation guiding devices;

wherein said shock absorbing devices or braking and damping devices (P1) counteract the opening movement and brake the closing movement of the first door leaf (A) and also of the second door leaf (B) hinged to said first door leaf (A); and a second rod (D2) hinged between said external side of the top (C) of the wardrobe (M) and an upper edge of said second door leaf (B), in such a way that the second rod rotates on a plane which is parallel and in proximity of the top (C).

3. The device according to claim 2, wherein said first and said second rods (D1, D2) are positioned on the top of the wardrobe or walk-in closet or piece of furniture, and wherein one or both of said rods (D1, D2) are hinged on a bushing or a locking or coupling device.

4. The device according to claim 1, wherein said first rod (D1) comprises guides (G2) for a mutual sliding movement between said first half rod (D11) and said second half rod (D12).

5. The device according to claim 1, wherein said shock absorbing devices or braking and damping devices (P1) operated through magnetic attraction dampen the opening and closing movement of the door leaf (A) during opening and closing and at the same time bring said first door leaf (A) back and hold it in said open and closed configurations.

6. The device according to claim 1, wherein said first rod (D1) is directly or indirectly hinged to said first door leaf (A) through a rod adjusting or supporting element (S1) and a plate (S3), by which it is possible to adjust a rotation of said first rod (D1) with respect to the first door leaf (A).

7. The device according to claim 1, wherein said first door leaf (A) is hinged to a jamb or vertical door leaf (F), or to a fixed component of the wardrobe with concealed hinges configured to allow a complete 180° rotation.

8. The device according to claim 1, further comprising damping elements (CP1) positioned inside cavities of the hollow cylinders (CC1), said damping elements being disposed to become compressed by action of the pins.

* * * * *